US006042405A

United States Patent [19]

Masuda et al.

[11] Patent Number: 6,042,405

[45] Date of Patent: Mar. 28, 2000

[54] RELAY SYSTEM BETWEEN RELATIVE ROTATION MEMBERS

[75] Inventors: Hiromi Masuda; Tomoyoshi Kikkawa, both of Shizuoka, Japan

[73] Assignee: Yazaki Corporation, Tokyo, Japan

[21] Appl. No.: 09/050,939

[22] Filed: Mar. 31, 1998

[30] Foreign Application Priority Data

Mar. 31, 1997 [JP] Japan ..... 9-080689

[51] Int. Cl.[7] ..... H01R 35/04

[52] U.S. Cl. ..... 439/164; 439/15

[58] Field of Search ..... 439/164, 15

[56] References Cited

U.S. PATENT DOCUMENTS 4,979,109 1/1989 Wende ..... 439/15

5,674,081 10/1997 Hoffmann et al. ..... 439/164

FOREIGN PATENT DOCUMENTS 7-282935 10/1995 Japan ..... H01R 35/04

*Primary Examiner*—Gary F. Paumen

*Attorney, Agent, or Firm*—Sughrue, Mion, Zinn, Macpeak & Seas, PLLC

[57] ABSTRACT

A relative rotation temporary stop mechanism 14 is integrally provided in a first rotor 11, and has a lock mechanism 140 elastically displaceable relative to the first rotor 11, and a lock recess portion 120*a* provided in a second rotor (stator) 12. The lock mechanism 140 has a lock protrusion portion 140*a* and an inclined portion 140*b* at its top end portion and at its base end portion respectively such that the lock protrusion portion 140*a* is fitted to the lock recess portion 120*a*. When an external connector A is connected to a direct connector 15, the inclined portion 140*b* is pushed by the external connector A to make the lock mechanism 140 move so that the lock protrusion portion 140*a* comes off from the lock recess portion 120*a*.

1 Claim, 13 Drawing Sheets

RELAY SYSTEM BETWEEN RELATIVE ROTATION MEMBERS

BACKGROUND OF THE INVENTION

1. Field of the Invention

The present invention relates to a relay system between relative rotation members for performing an electric connection between two members rotating relatively to each other, and particularly relates to a relay system between relative rotation members having a mechanism for temporarily fixing two members rotating relatively to each other.

2. Related Art

As a relay system between relative rotation members of this type, for example, known is that which is disclosed in Japanese Patent Unexamined Publication No. Hei-7-282935. The relay system between relative rotation members disclosed in this publication has first and second rotors rotating relatively to each other, in which the first rotor is provided with a lock mechanism and the second rotor is provided with a lock recess portion.

The lock mechanism has its top end portion which may be fitted into the lock recess portion to prohibit the relative rotation between the first rotor and the second rotor. The movement of the lock mechanism is restricted by a detent mechanism to thereby keep the state in which the top end portion is fitted in the lock recess portion.

In addition, a direct connector is provided in the first rotor. The lock mechanism is moved by an external connector so as to be connected to this direct connector and the top end portion of the lock mechanism is detached from the lock recess portion so as to enable the relative rotation between the first rotor and the second rotor.

However, in the above-mentioned relay system between relative rotation members, the lock mechanism was constituted by a separate body different from the first rotor, and the detent mechanism for restricting this lock mechanism was required. Accordingly, the number of parts was large, and the structure was complicated. Therefore, there were problems in workability of assembling and in cost.

SUMMARY OF THE INVENTION

The present invention is achieved to solve the foregoing problems. It is an object of the present invention to provide a relay system between relative rotation members in which the number of parts is reduced and the structure is simplified, so that it is possible to improve the workability of assembling and reduce the cost.

In order to attain the above object, according to the present invention, provided is a relay system between relative rotation members comprising: first and second rotors which rotate relative to each other and which are connected electrically to each other through a cable; and a relative rotation temporary stop mechanism being provided for temporarily stopping the relative rotation between the first and second rotors; provided in that a direct connector for connecting the cable to the outside is provided in the first rotor; the relative rotation temporary stop mechanism is provided with a lock mechanism provided integrally with the first rotor so as to be elastically displaceable relative to the first rotor, and a lock recess portion provided in the second rotor; the lock mechanism includes a lock protrusion portion and an inclined portion, provided at its top end portion and at its base end portion respectively, the lock protrusion portion being fitted into the lock recess portion; and when an external connector is connected to the direct connector, the inclined portion is pushed by the external connector to thereby move the lock mechanism so that the lock protrusion portion is detached from the lock recess portion.

According to the present invention, provided is a relay system between relative rotation members comprising: first and second rotors which rotate relatively to each other and which are connected electrically to each other through a cable; and a relative rotation temporary stop mechanism being provided for temporarily stopping the relative rotation between the first and second rotors; provided in that the relative rotation temporary stop mechanism is provided with a lock mechanism provided integrally with the first rotor so as to be elastically displaceable relative to the first rotor, and a lock recess portion provided in the second rotor; the lock mechanism includes a lock protrusion portion and an inclined portion, provided at its top end portion and at its base end portion respectively, the lock protrusion portion being fitted into the lock recess portion; and when the first rotor is connected to an external connection mechanism, the inclined portion is pushed by the external connection mechanism to thereby move the lock mechanism so that the lock protrusion portion is detached from the lock recess portion.

According to the present invention, provided is a relay system between relative rotation members comprising: first and second rotors which rotate relative to each other and which are connected electrically to each other through a cable; and a relative rotation temporary stop mechanism being provided for temporarily stopping the relative rotation between the first and second rotors; provided in that a direct connector for connecting the cable to the outside is provided in the first rotor; the relative rotation temporary stop mechanism is provided with a lock mechanism provided integrally with the first rotor so as to be elastically displaceable relative to the first rotor, and a lock recess portion provided in the second rotor; the lock mechanism includes a lock protrusion portion and a power point portion, provided at its top end portion and at its base end portion respectively; and when an external connector is connected to the direct connector, the power point portion is pushed by the external connector to thereby move the lock mechanism so that the lock protrusion portion is detached from the lock recess portion.

According to the present invention, provided is a relay system between relative rotation members comprising: first and second rotors which rotate relatively to each other and which are connected electrically to each other through a cable; and a relative rotation temporary stop mechanism being provided for temporarily stopping the relative rotation between the first and second rotors provided in that the relative rotation temporary stop mechanism is provided with a lock mechanism provided integrally with the first rotor so as to be elastically displaceable relative to the first rotor, and a lock recess portion provided in the second rotor; the lock mechanism includes a lock protrusion portion and a power point portion, provided at its top end portion and at its base end portion respectively; and when the first rotor is connected to an external connection mechanism, the power point portion is pushed by the external connection mechanism to thereby move the lock mechanism so that the lock protrusion portion is detached from the lock recess portion.

In the present invention configured thus, the lock protrusion portion of the lock mechanism is fitted into the lock recess portion by assembling the first rotor and the second rotor so that the relative rotation between the first rotor and the second rotor is prohibited. In this case, preferably, the first rotor and the second rotor are assembled with each other in their neutral position so that the lock protrusion portion is fitted into the lock recess portion.

That is, being connected to each other through a cable, the first and second rotors are rotatable freely relative to each other within a predetermined number of rotations. Accordingly, for example, in the case where the first and second rotors are installed in a rotation boundary portion between a body of a car and a steering wheel, it is preferable to attach the rotors in the rotation boundary portion in a state that they are set in a neutral position.

In any event, if the first and second rotors are locked and the initial condition of the relative rotation is established in advance, they can be installed as they are in the steering wheel or in any other rotation boundary portion. It is therefore possible to save such a labor that is required to adjust the rotation range while checking the allowance of the cable.

In addition, since the lock mechanism is provided integrally with the first rotor, it is possible to reduce the number of parts. In addition, since no mechanism is required for restricting or guiding the position of the lock mechanism, it is possible to simplify the structure. It is therefore possible to improve the workability of assembling and reduce the cost.

Further, if the first and second rotors are assembled, the lock protrusion portion is fitted directly into the lock recess portion so that the first and second rotors are brought into a locked state. It is therefore possible to save a labor to bring these rotors into a locked state. Moreover, only by fitting an external connector to the direct connector, the lock mechanism moves so that the lock protrusion portion comes off from the lock recess portion. It is therefore possible to save a labor to bring the rotors into an unlocked state.

In the present invention, only by connecting an external connection mechanism such as a steering wheel, or the like, to the first rotor, the lock mechanism moves so that the lock protrusion portion comes off from the lock recess portion. It is therefore possible to save a labor to bring the rotors into an unlocked state.

In the present invention, only by fitting an external connector to the direct connector, the lock mechanism swings so that the lock protrusion portion comes off from the lock recess portion. It is therefore possible to save a labor to bring the rotors into an unlocked state.

In the present invention, only by connecting an external connection mechanism such as a steering wheel, or the like, to the first rotor, the lock mechanism swings so that the lock protrusion portion comes off from the lock recess portion. It is therefore possible to save a labor to bring the rotors into an unlocked state.

DETAILED DESCRIPTION OF THE PREFERRED EMBODIMENT

Figure 16:
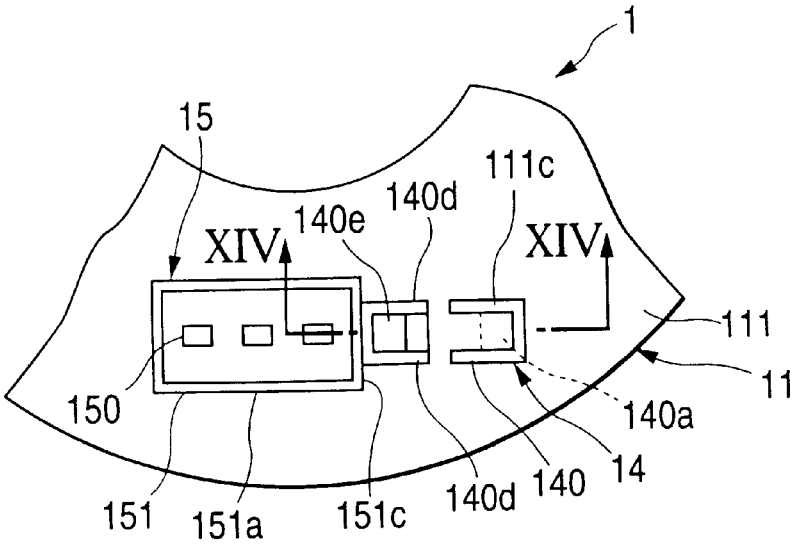
FIG. 16 is a main part plan view of the same relay system between relative rotation members shown as another example of the third embodiment.
Figure 17:
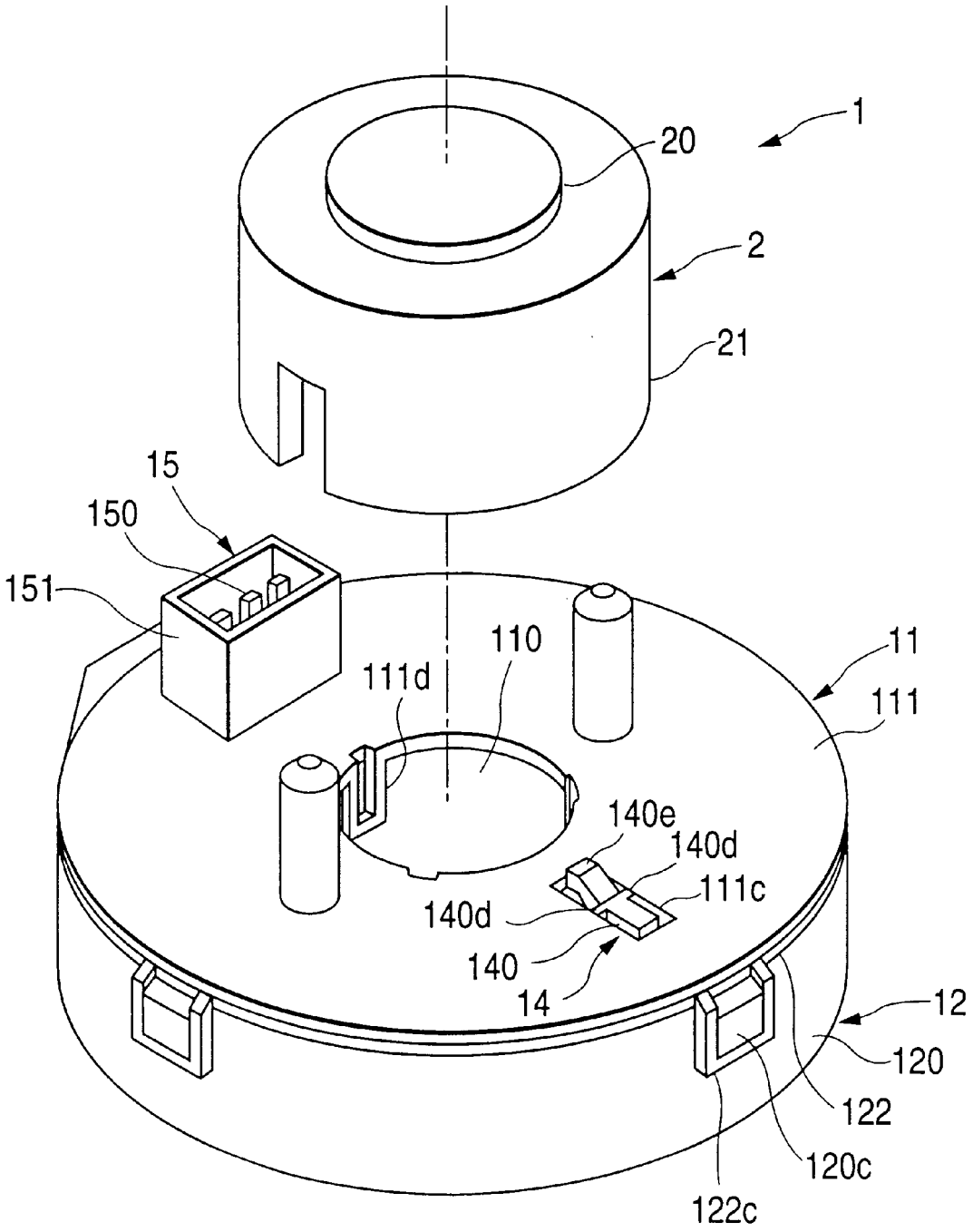
FIG. 17 is a perspective view of a relay system between relative rotation members shown as a fourth embodiment of the present invention.
Figure 18:
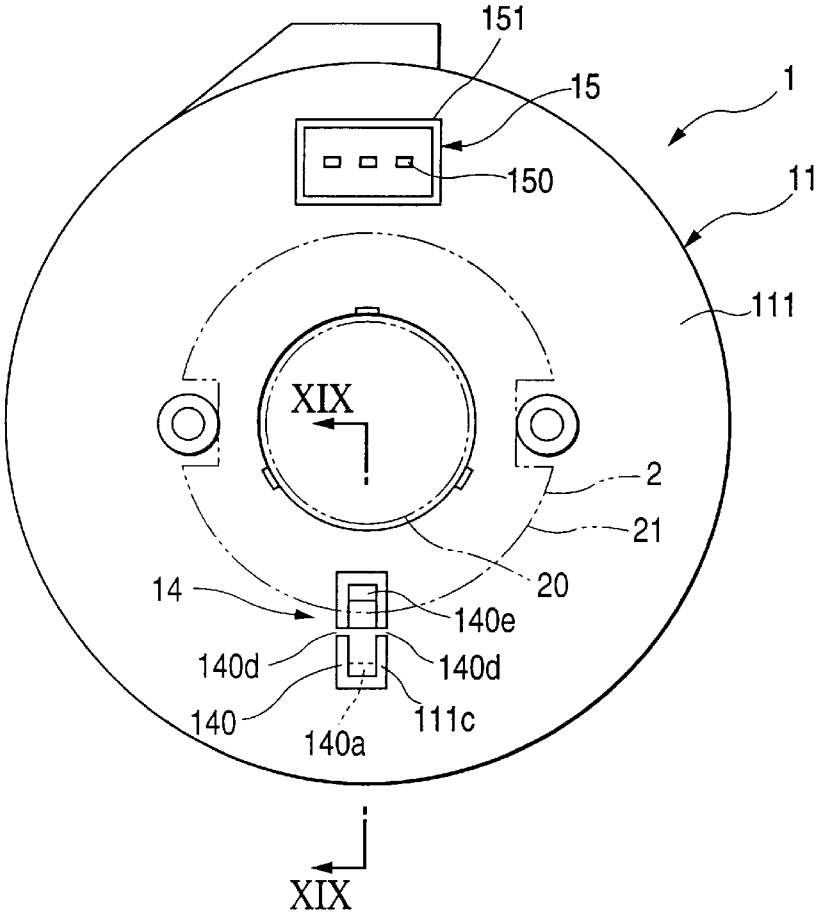
FIG. 18 is a plan view of the same relay system between relative rotation members.
Figure 19:
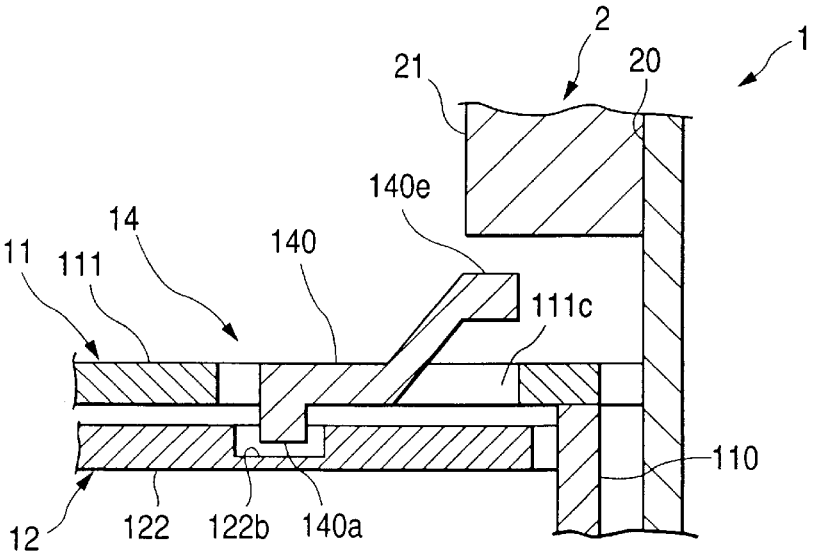
FIG. 19 is a sectional view taken on line XIX—XIX of FIG. 18, showing the same relay system between relative rotation members.

Modes for carrying out the present invention will be described below on the basis of various embodiments with reference to the drawings. FIGS. 1 to 6 show a first embodiment, FIGS. 7 to 10 show a second embodiment, FIGS. 11 to 15 show a third embodiment, FIG. 16 shows another form of the third embodiment, and FIGS. 17 to 19 show a fourth embodiment.

First Embodiment

First, the first embodiment according to the present invention will be described with reference to FIGS. 1 to 6. As shown in FIGS. 1 to 4, a relay system 1 between relative rotation members shown in this first embodiment has a stator 12 (second rotor), and a rotor 11 (first rotor) which rotates relative to the stator 12. The rotor 11 and the stator 12 are electrically connected to each other through a flexible flat cable (cable) 13 (see FIG. 3). The relay system 1 is also provided with a relative rotation temporary stop mechanism 14 for temporarily stopping the relative rotation between the rotor 11 and the stator 12.

Figure 1:
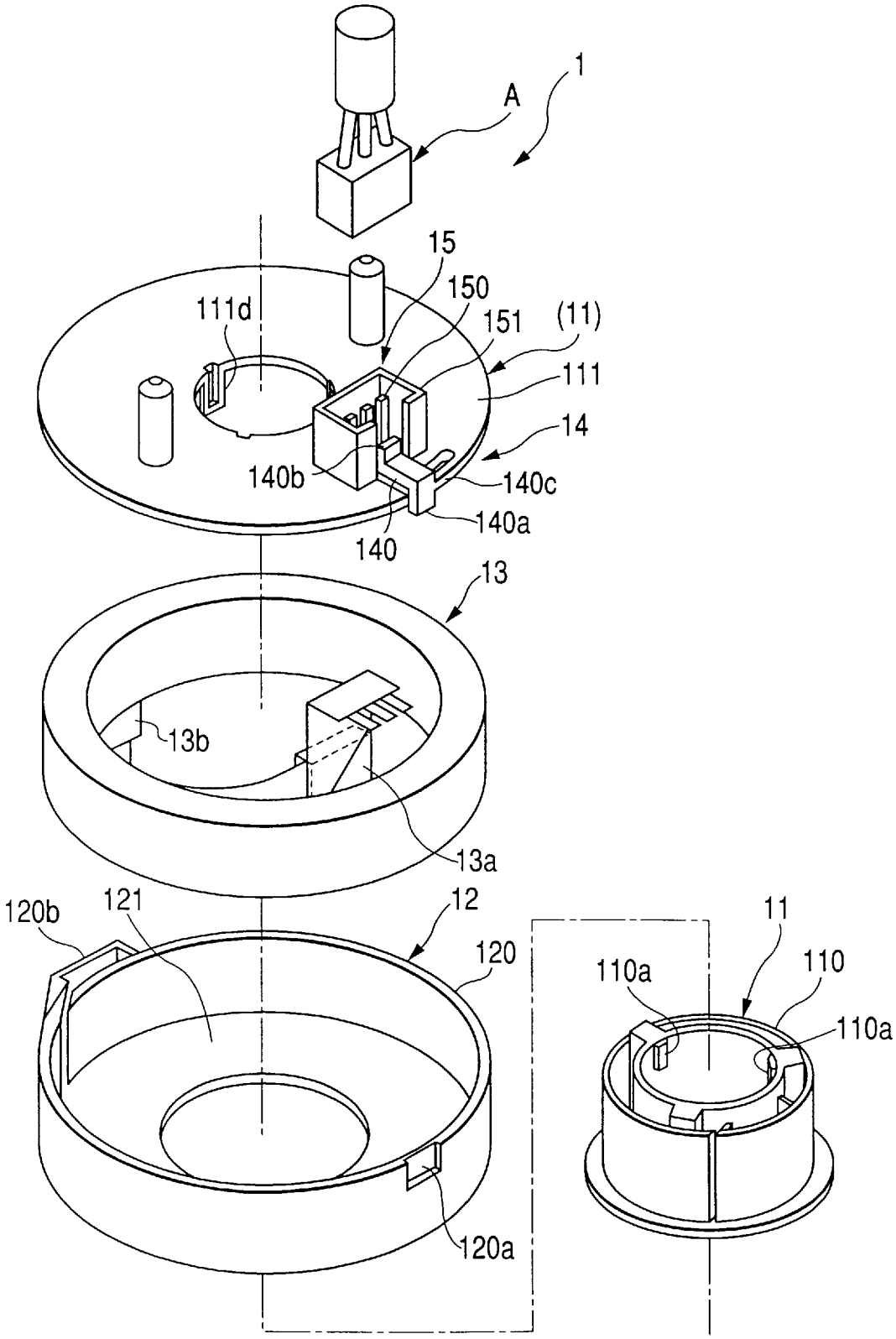
FIG. 1 is an exploded perspective view of a relay system between relative rotation members shown as a first embodiment of the present invention.
Figure 2:
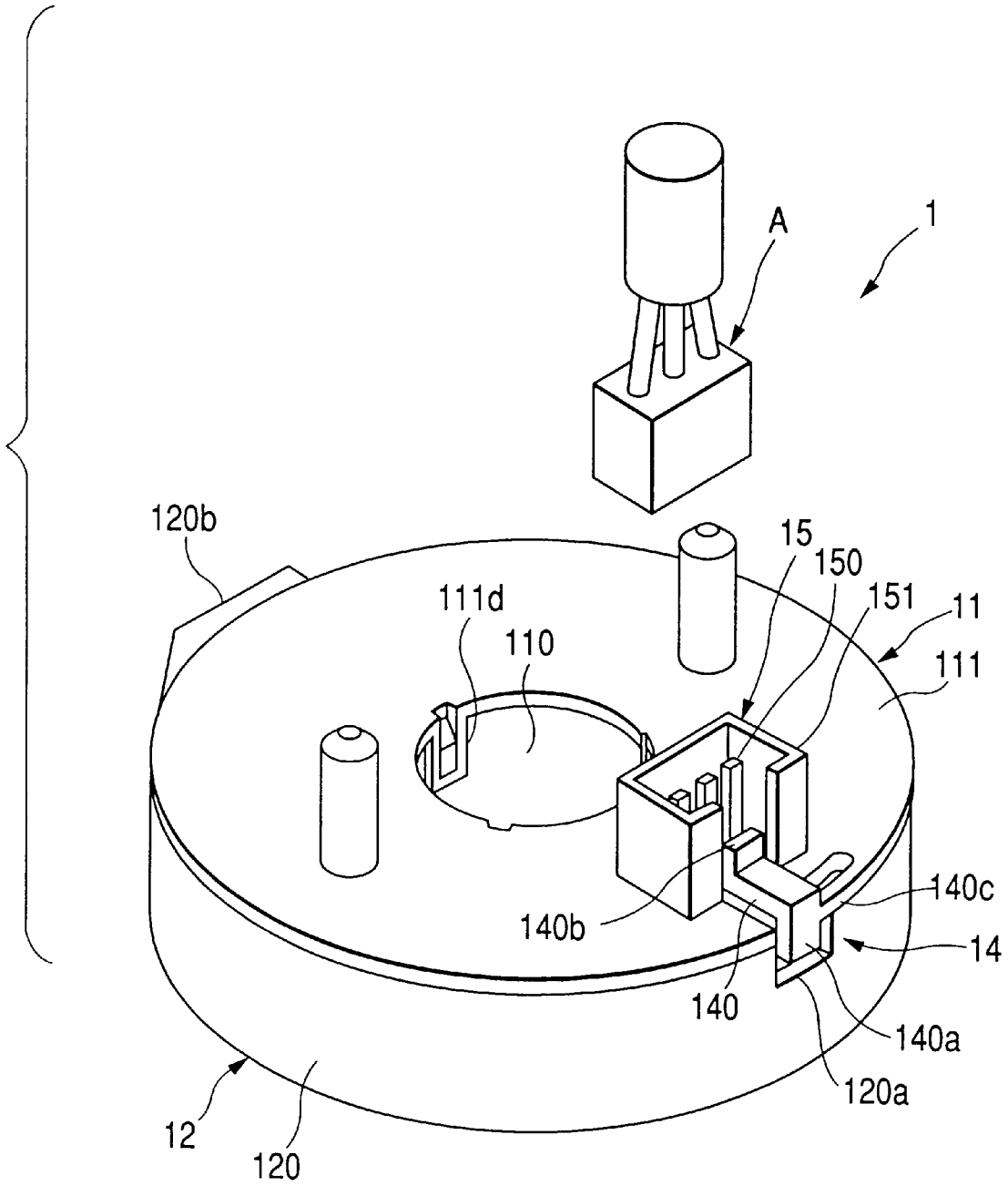
FIG. 2 is a perspective view of the same relay system between relative rotation members.
Figure 3:
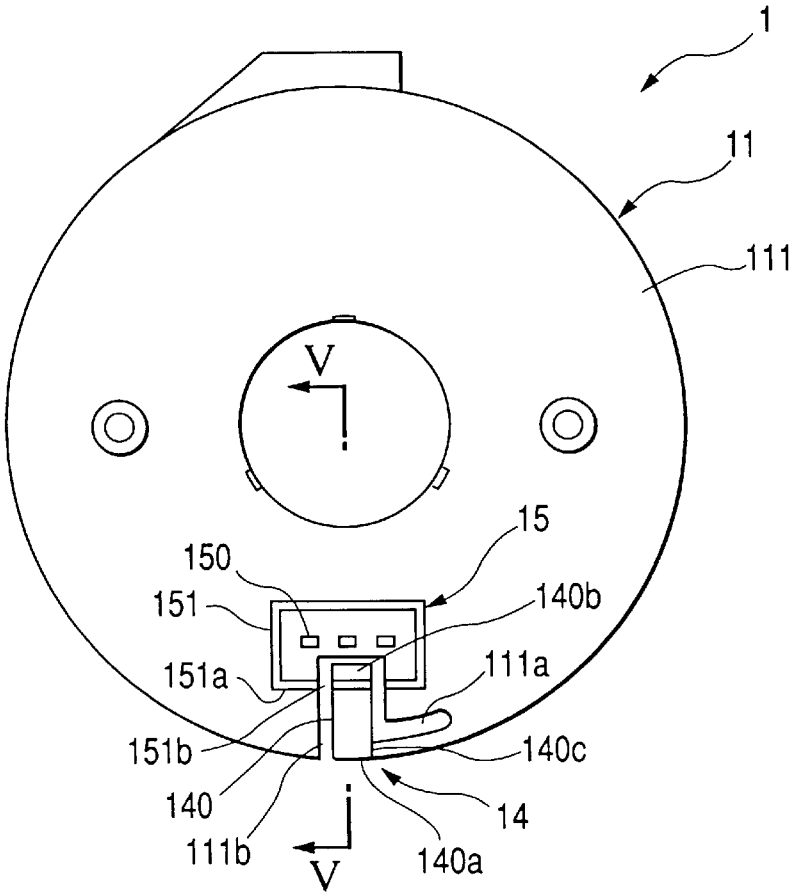
FIG. 3 is a plan view of the same relay system between relative rotation members.
Figure 4:
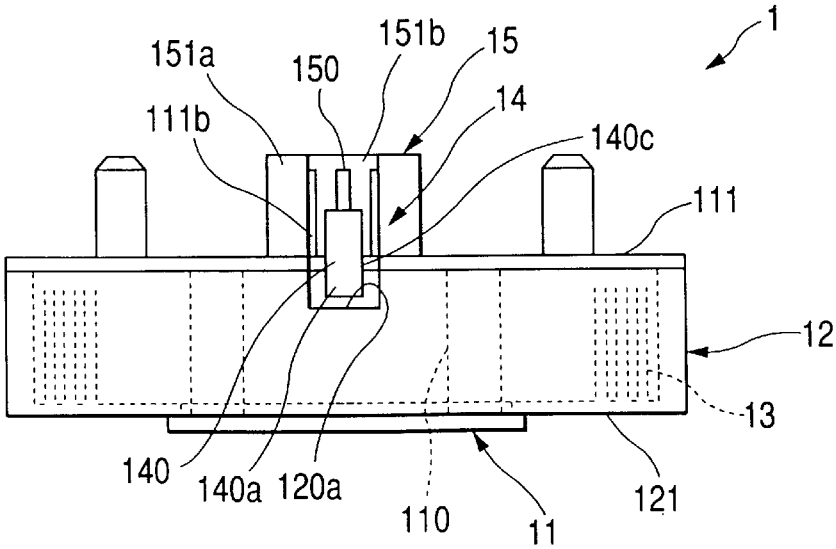
FIG. 4 is a side view of the same relay system between relative rotation members.

As shown in FIGS. 1 and 4, the rotor 11 has an inner cylinder 110, and a ceiling plate 111 which is fixed to this inner cylinder 110 through a locking member 111*d* and a locked member 110*a* and which spreads circularly and radially outside from the upper end portion of the inner cylinder 110. The locking member 111*d* is formed integrally with the ceiling plate 111, and the locked member 110*a* is formed integrally with the inner cylinder 110. The stator 12 has a bottom plate 121 which spreads circularly and radially outside from the lower end portion of the inner cylinder 110, and an outer cylinder 120 which extends upward from the outer circumferential portion of the bottom plate 121. In addition, the flexible flat cable 13 is disposed in an annular space formed between the inner cylinder 110 and the outer cylinder 120.

The flexible flat cable 13 is designed so that the one end portion 13*a* of the cable 13 enters the inner cylinder 110, and conductors of the cable 13 are connected to a direct connector 15 provided in the ceiling plate 111, while the other end portion 13*b* is connected to the outside from a cable holding portion 120*b* of the outer cylinder 120 through a not-shown connector or the like.

As shown in FIGS. 1 to 4, in the direct connector 15 which is to be connected to an external connector A, a guide wall portion 151 is formed like a square pipe integrally with the ceiling plate 111 so that the guide wall portion 151 surrounds a connection pin 150.

In the guide wall portion 151, one outer side 151*a* is directed in a direction perpendicular to a straight line extending radially from the center of the ceiling plate 111, and a first notch 151*b* extending up/down is formed in this side 151*a*. This first notch 151*b* is formed at the widthwise center of the side 151*a* so as to penetrate the ceiling plate 111 to reach its bottom.

The relative rotation temporary stop mechanism 14 has a lock mechanism 140 which is provided integrally with the ceiling plate 111 of the rotor 11 and which is elastically displaceable relative to the rotor 11, and a lock recess portion 120*a* which is provided in the outer cylinder 120 of the stator 12.

The lock mechanism 140 is configured to extend radially outside from the center of the first notch 151*b*. A lock protrusion portion 140*a* to be fitted into the lock recess portion 120*a* is formed at the top end portion of the lock mechanism 140, and an inclined portion 140*b* is formed at the base end portion of the same. In the lock mechanism 140, a side portion of its top end portion is integrally connected to the ceiling plate 111 of the rotor 11 through a connection portion 140*c*, and a slit 111*a* is formed so as to extend circumferentially along the inside of this connection portion 140*c*. The lock mechanism 140 is made elastically displaceable radially inward and outward by the slit 111*a*. In addition, the lock mechanism 140 is disposed in a second notch 111*b* provided in the ceiling plate 111.

This second notch 111*b* extends from the first notch 115*b* up to the outer circumferential end in the radial outside of the ceiling plate 111 with the same width as the first notch 151*b*, except the connection portion 140*c*.

The lock recess portion 120*a* is formed in the outer circumferential upper end portion of the outer cylinder 120 of the stator 12 with the same width as the second notch 111*b*. The range of the relative rotation between the rotor 11 and the stator 12 is limited by the flexible flat cable 13. Then, the circumferential position of the lock recess portion 120*a* is determined so that the lock protrusion portion 140*a* enters the lock recess portion 120*a* when the rotor 11 is installed in a neutral position in which the rotor 11 can rotate relative to the stator 12 in the same range to both the left and right directions.

Figure 5:
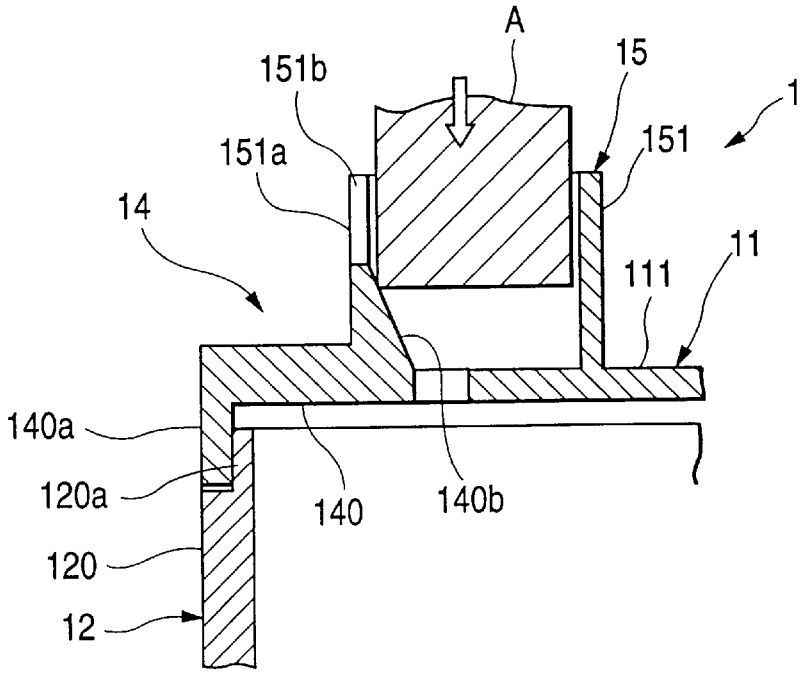
FIG. 5 is a sectional view taken on line V—V of FIG. 3, showing the same relay system between relative rotation members.
Figure 6:
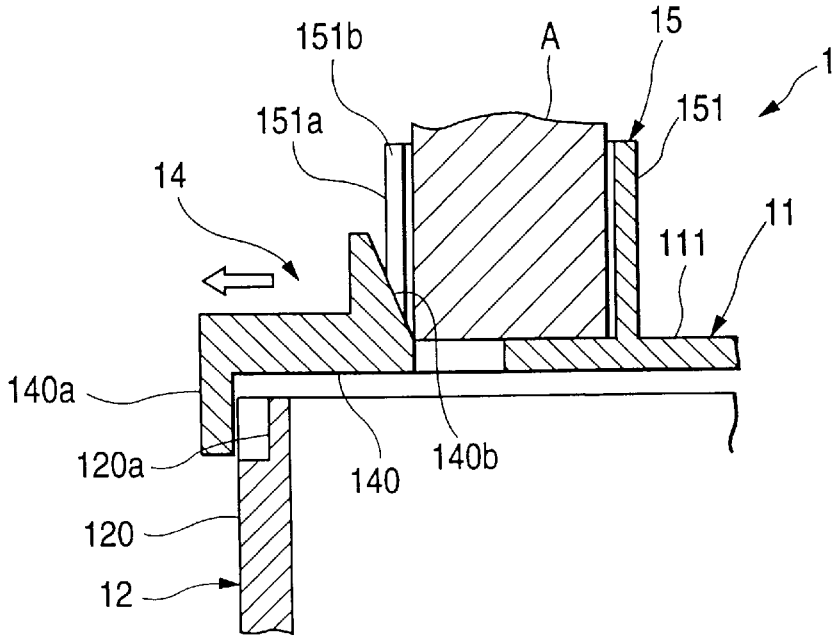
FIG. 6 is a sectional view taken on line V—V of FIG. 3, showing the same relay system between relative rotation members.

As shown in FIGS. 5 and 6, the inclined portion 140*b* is configured so that, when an external connector A is connected to the direct connector 15, the inclined portion 140*b* is pushed by the external connector A to thereby move the lock mechanism 140 as a whole radially outward so that the lock protrusion portion 140*a* comes off from the lock recess portion 120*a*. That is, the inclined portion 140*a* is formed to incline obliquely downward toward the inside of the first notch 151*b* so that the lock mechanism 140 as a whole is moved radially outward by the external connector A which is being inserted into the direct connector 15.

The ceiling plate 111 is formed from synthetic resin so as to be integrated into one body with the direct connector 15 and the lock mechanism 140. In addition, the inner cylinder 110 and the ceiling plate 111 are configured so that they can be separated from each other by mechanism of the locking member 111*d* and the locked member 110*a* in this embodiment. However, the inner cylinder 110 and the ceiling plate 111 may be formed from the same synthetic resin integrally with each other.

In the relay system 1 between relative rotation members configured thus, if the rotor 11 is assembled with the stator 12 so as to be in a neutral position, the lock protrusion portion 140*a* is fitted to the lock recess portion 120*a*. Accordingly the rotor 11 and the stator 12 are prohibited to rotate relative to each other. That is, the rotor 11 and the stator 12 are locked with each other.

Then, for example, while a steering of a car is set in a neutral position, the stator 12 is connected to a steering column on the vehicle body side, and the rotor 11 is connected to a steering wheel. Next, one end portion of the flexible flat cable 13 is connected to the wiring on the steering wheel side through the direct connector 15 and the external connector A while the other end portion of the flexible flat cable 13 is connected to the wiring on the vehicle body side through a connector or the like.

When the external connector A is connected to the direct connector 15, the lock protrusion portion 140*a* is detached from the lock recess portion 120*a*, so that the rotor 11 is made free to rotate relative to the stator 12. In this lock release, since the rotor 11 has already been set in a neutral position, it is possible to save a labor to set a neutral position while checking the allowance of the flexible flat cable 13.

Moreover, since the lock mechanism 140 is formed integrally with the rotor 11, it is possible to reduce the number of parts. In addition, since no mechanism such as a detent mechanism, or the like, for restricting or guiding the movement of the lock mechanism 140 is required, it is possible to simplify the structure. Accordingly, it is possible to improve the workability of assembling and reduce the cost.

Further, only by assembling the rotor 11 with the stator 12, the lock protrusion portion 140*a* is fitted into the lock recess portion 120*a* so that the rotor 11 and the lock recess portion 120*a* can be locked with each other. It is therefore possible to save a labor to lock these parts. In addition, only by fitting the external connector A into the direct connector 15, the lock mechanism 140 moves to detach the lock protrusion portion 140*a* from the lock recess portion 120*a*. Accordingly, it is possible to save a labor to release these parts from the locked state.

Second Embodiment

Next, the second embodiment according to the present invention will be described below with reference to FIGS. 7 to 10. The constituents the same as those in the above first embodiment are referenced correspondingly, and description about them will be omitted here.

Figure 7:
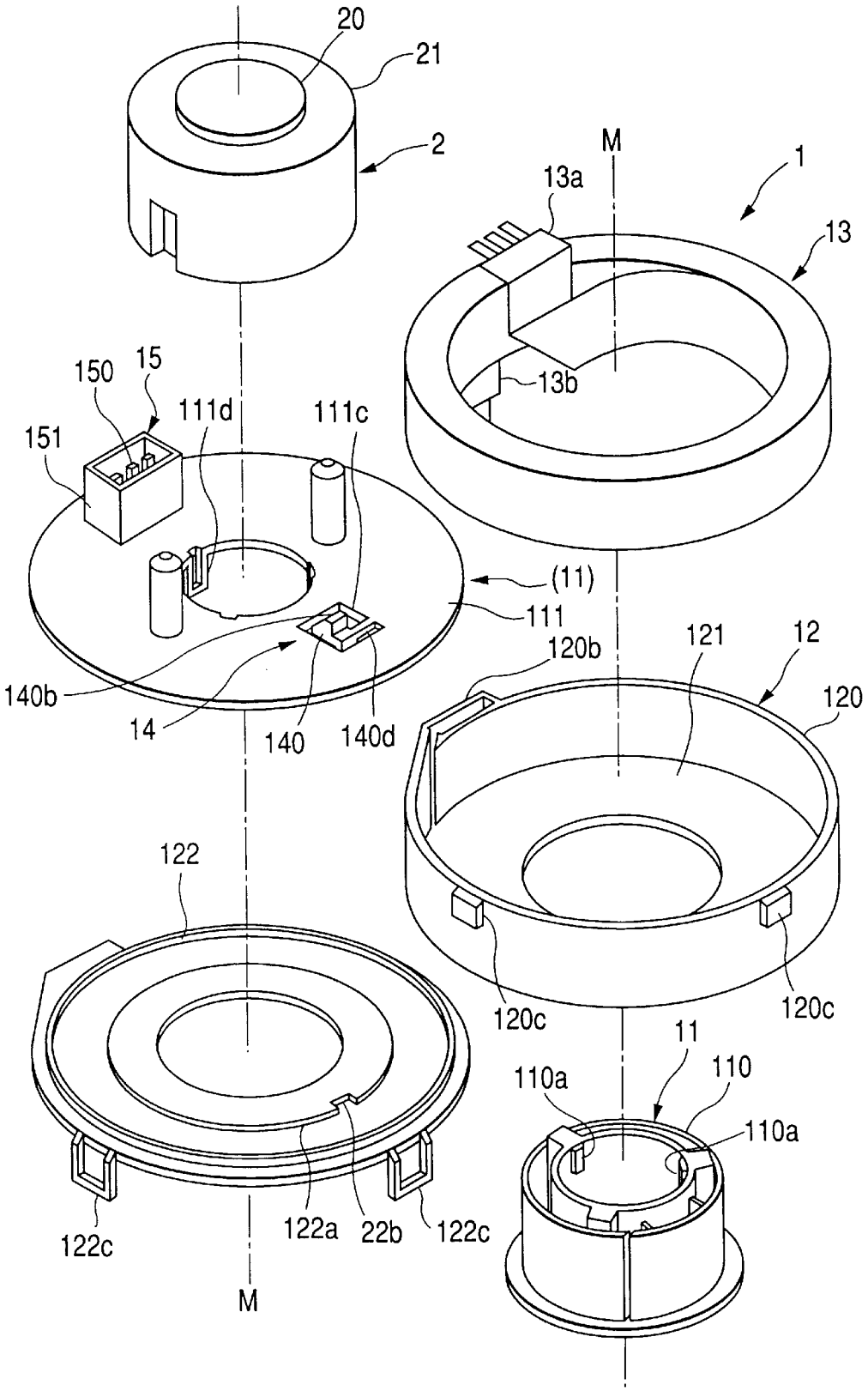
FIG. 7 is an exploded perspective view of a relay system between relative rotation members shown as a second embodiment of the present invention.
Figure 8:
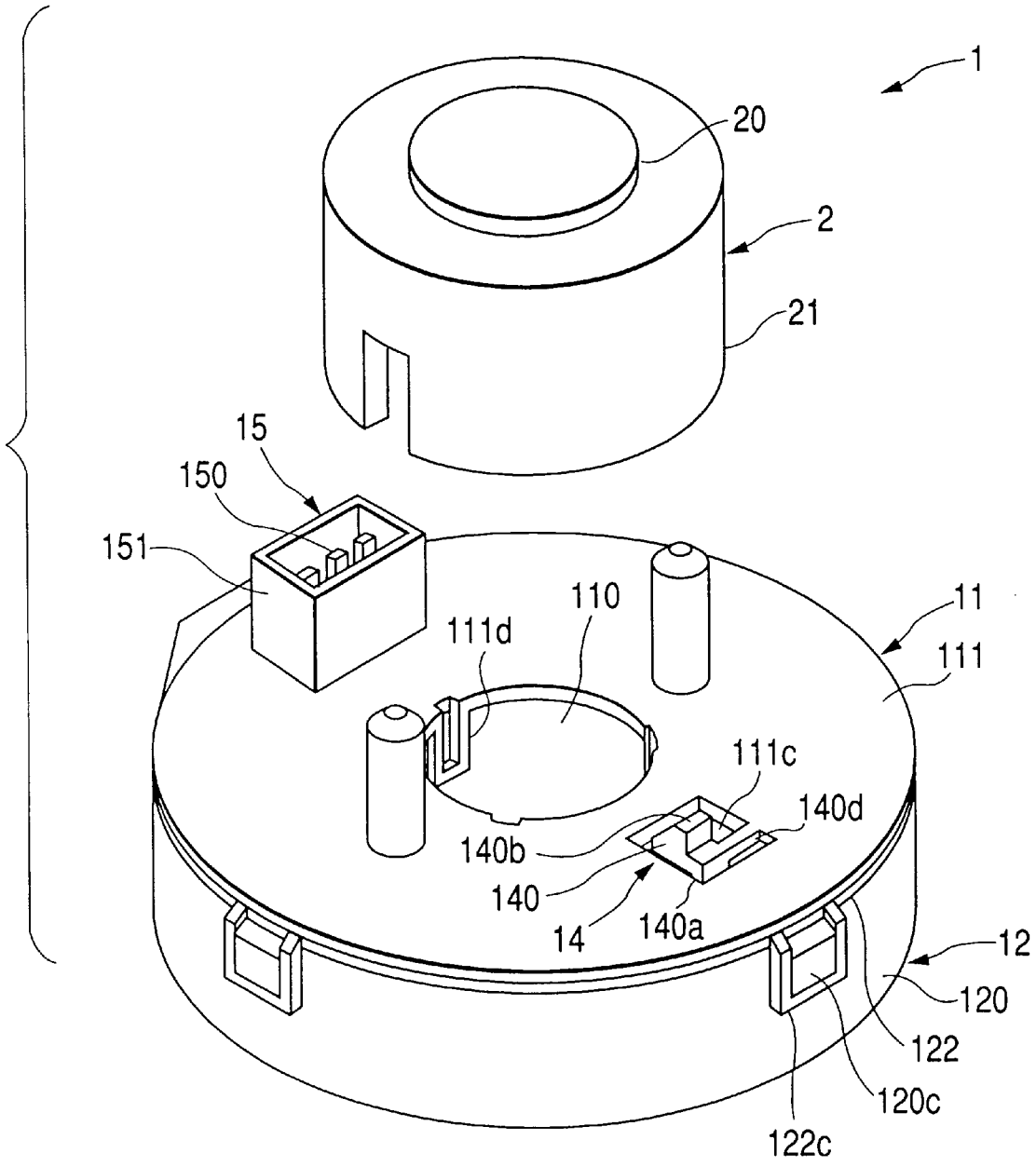
FIG. 8 is a perspective view of the same relay system between relative rotation members.

In a stator 12 shown in this second embodiment, a lower ceiling plate 122 is provided to reach the vicinity of an inner cylinder 110 from the upper end of an outer cylinder 120 so as to be disposed under a ceiling plate 111 as shown in FIGS. 7 and 8. This lower ceiling plate 122 is detachably attached to the outer cylinder 120 through a locking member 122*c* and a locked member 120*c*. After a flexible flat cable 13 is mounted on a bottom plate 121, the lower ceiling plate 122 is fixed to the outer cylinder 120. The locking member 122*c* is formed integrally with the lower ceiling plate 122, and the locked member 120*c* is formed integrally with the outer cylinder 120.

The outer cylinder 120, the bottom plate 121 and the lower ceiling plate 122 may be formed, for example, from synthetic resin integrally with each other. In such a case, the flexible flat cable 13 is inserted into the stator 12 from the inside.

Figure 10:
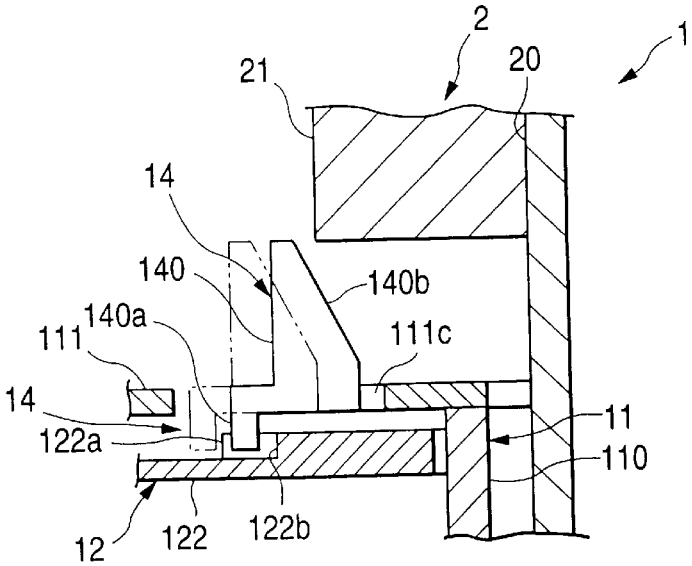
FIG. 10 is a sectional view taken on line X—X of FIG. 9, showing the same relay system between relative rotation members.

As shown in FIGS. 7 and 10, in the lower ceiling plate 122, a stepped side 122*a* is formed so as to direct radially outward, and a lock recess portion 122*b* is formed in the stepped side 122*a* so that a lock protrusion portion 140*a* of a lock mechanism 140 is fitted to the lock recess portion 122*b*.

Figure 9:
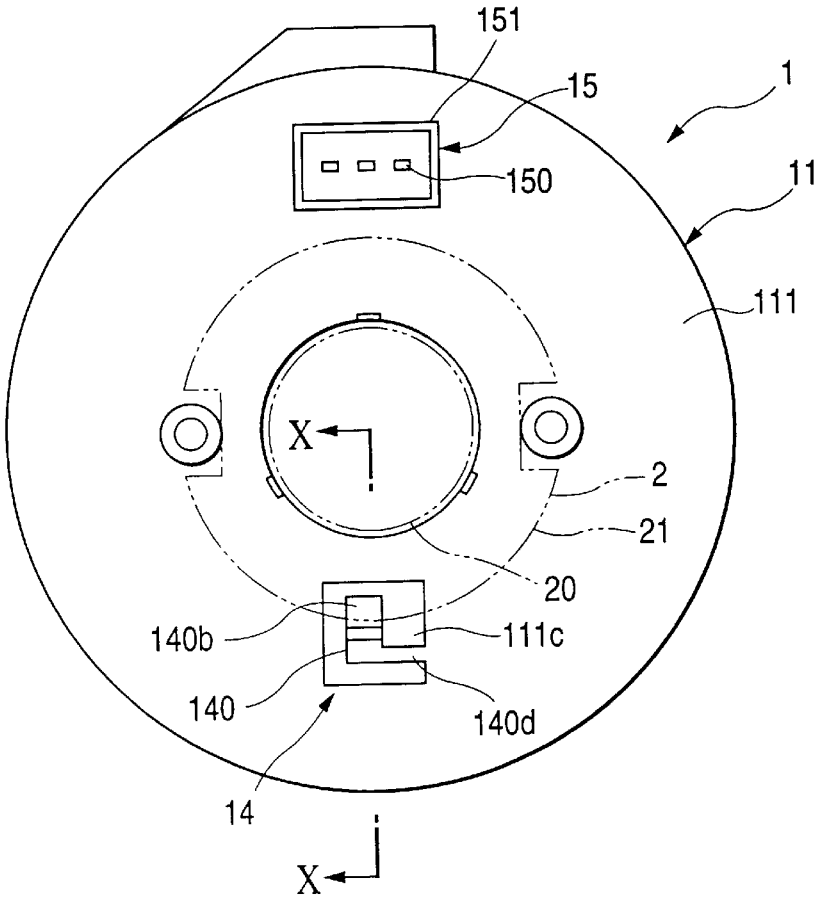
FIG. 9 is a plan view of the same relay system between relative rotation members.

As shown in FIGS. 7 to 9, the lock mechanism 140 is formed integrally with the ceiling plate 111 through an arm 140*d* and disposed in a square notch 111*c* formed in the ceiling plate 111. The notch 111*c* is formed so that its respective outer and inner sides are perpendicular to a line extending radially outward from the center of the ceiling plate 111. The arm 140*d* extends from one of the left and right sides of the notch 111*c* toward the inside of the notch 111*c* perpendicularly to the lock mechanism 140.

In addition, as shown in FIG. 10, the lock mechanism 140 is configured to extend radially outward from the center of the ceiling plate 111, and the lock protrusion portion 140*a* is formed at the top end portion of the lock mechanism 140 while an inclined portion 140*b* is formed at the base end portion of the same.

The inclined portion 140*b* is pushed by a steering wheel (external connection mechanism) 2 when the rotor 11 is connected to the steering wheel 2. The steering wheel 2 has a steering shaft 20 penetrating the inner cylinder 110 and a steering boss 21 provided around this steering shaft 20. This steering boss 21 is designed to push the inclined portion 140*b*.

That is, the inclined portion 140*a* is inclined obliquely downward toward the inside of the ceiling plate 111. When the rotor 11 is fixed to the steering wheel 2, the inclined portion 140*a* is pushed by the steering boss 21 to radially outward move the lock mechanism 140 as a whole to make the lock protrusion portion 140*a* come off from the lock recess portion 122*b*.

In addition, the ceiling plate 111 is formed from synthetic resin integrally with the lock mechanism 140 to be one body.

In the relay system 1 between relative rotation members configured thus, only by connecting the steering wheel 2 to the rotor 11, the lock protrusion portion 140*a* can be detached from the lock recess portion 122*b*. Accordingly, it is possible to save a labor to release these portions from the locked state. Other operations and effects the same as those in the first embodiment can be provided.

Although the lower ceiling plate 122 is provided, and the lock recess portion 122*b* is formed in the stepped side 122*a* in the above embodiment, the lock recess portion 120*a* may be formed in the outer cylinder 120 without providing such a lower ceiling plate 122 so that the lock protrusion portion 140*a* of the lock mechanism 140 is fitted into this lock recess portion 120*a* like the first embodiment.

Third Embodiment

Next, the third embodiment according to the present invention will be described below with reference to FIGS. 11 to 15. The constituents the same as those in the above first embodiment are referenced correspondingly, and description about them will be omitted here.

Figure 11:
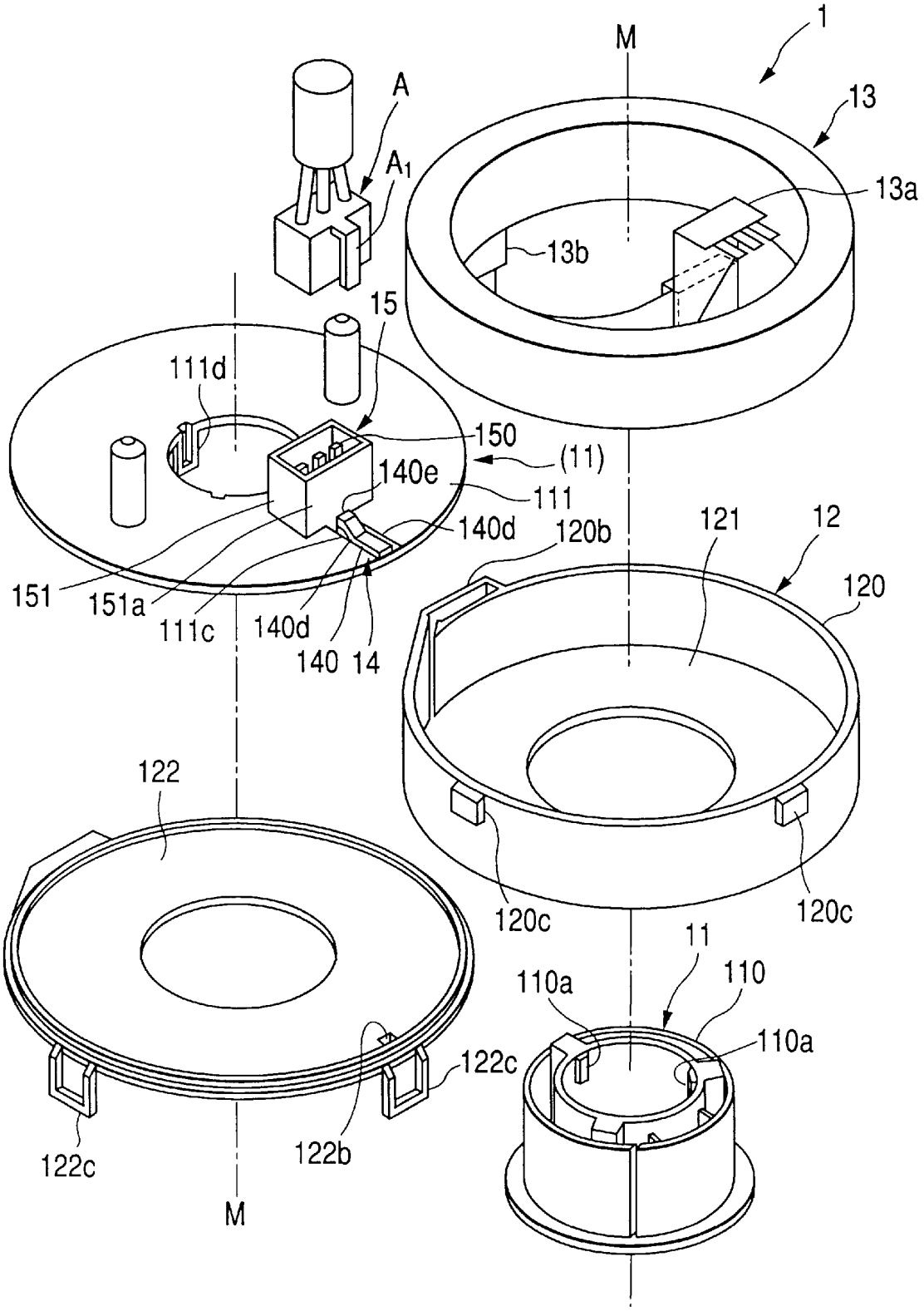
FIG. 11 is an exploded perspective view of a relay system between relative rotation members shown as a third embodiment of the present invention.

In a stator 12 shown in this third embodiment, a lower ceiling plate 122 is provided to reach the vicinity of an inner cylinder 110 from the upper end of an outer cylinder 120 so as to be disposed under a ceiling plate 111 as shown in FIG. 11. This lower ceiling plate 122 is detachably attached to the outer cylinder 120 through a locking member 122*c* and a locked member 120*c*. After a flexible flat cable 13 is mounted on a bottom plate 121, the lower ceiling plate 122 is fixed to the outer cylinder 120. The locking member 122*c* is formed integrally with the lower ceiling plate 122, and the locked member 120*c* is formed integrally with the outer cylinder 120. The outer cylinder 120, the bottom plate 121 and the lower ceiling plate 122 may be formed, for example, from synthetic resin integrally with each other. In such a case, the flexible flat cable 13 is inserted into the stator 12 from the inside.

Figure 14:
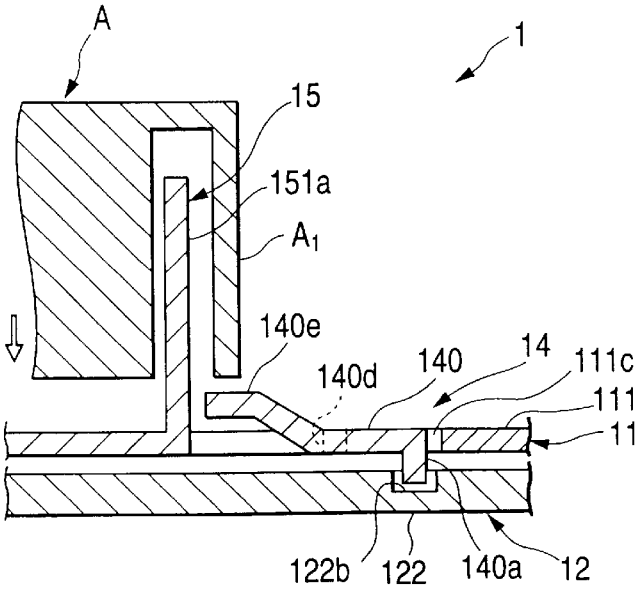
FIG. 14 is a sectional view taken on line XIV—XIV of FIG. 13; showing the same relay system between relative rotation members.
Figure 15:
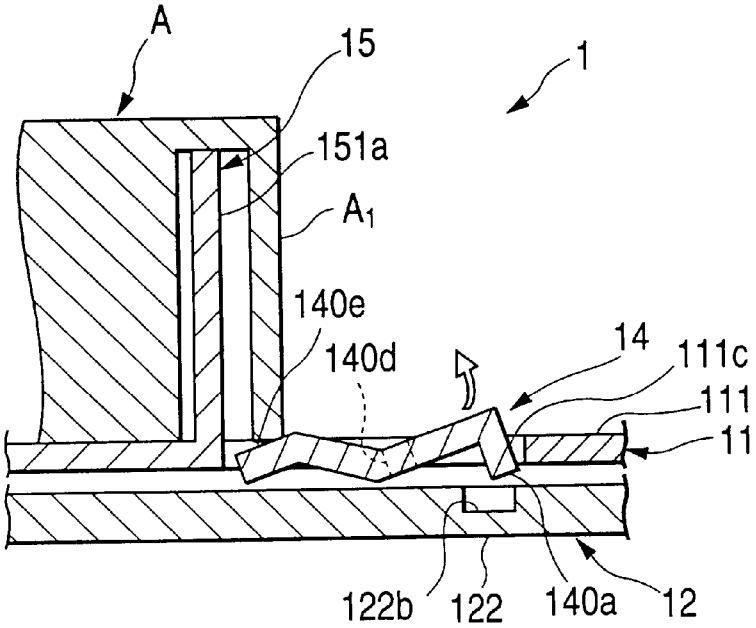
FIG. 15 is a sectional view taken on line XIV—XIV of FIG. 13, showing the same relay system between relative rotation members.

As shown in FIGS. 14 and 15, a lock recess portion 122*b* is formed on the upper surface of the lower ceiling plate 122 so that a lock protrusion portion 140*a* of a lock mechanism 140 is fitted to the lock recess portion 122*b*.

Figure 12:
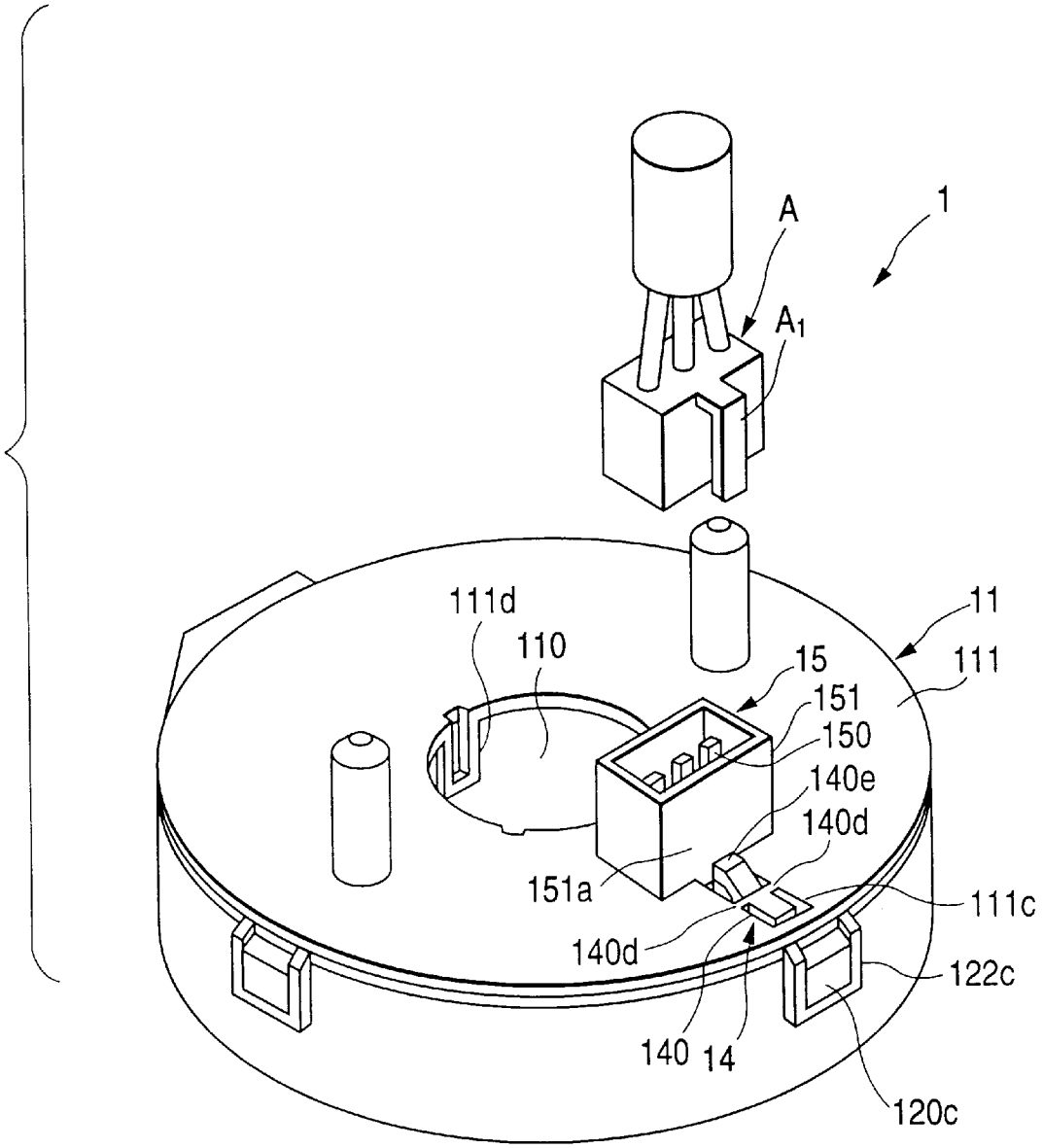
FIG. 12 is a perspective view of the same relay system between relative rotation members.
Figure 13:
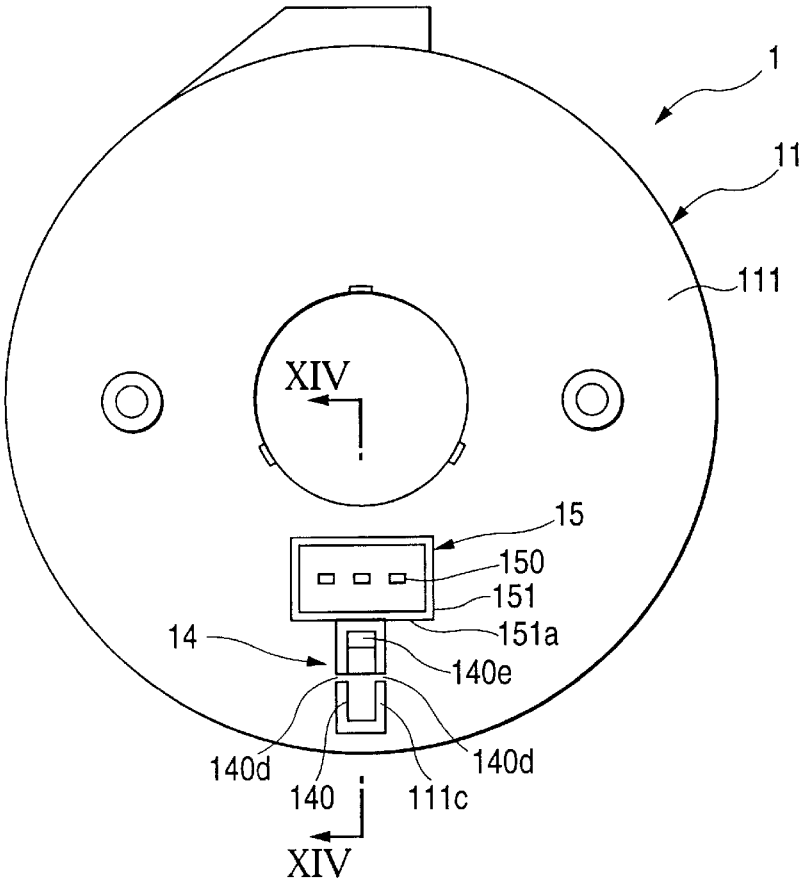
FIG. 13 is a plan view of the same relay system between relative rotation members.

As shown in FIGS. 11 to 13, the lock mechanism 140 is disposed in a square notch 111*c* formed in the ceiling plate 111 and connected integrally with the ceiling plate 111 through arms 140*d* formed on the left and right sides of the lock mechanism 140. The notch 111*c* is formed so that its respective outer and inner sides are perpendicular to a line extending radially outward from the center of the ceiling plate 111. The arms 140*d* are formed to connect the respective left and right sides of the notch 111*c* to the longitudinal center portion of the lock mechanism 140 so as to make the lock mechanism 140 swingable elastically.

In addition, as shown in FIGS. 14 and 15, the lock mechanism 140 is configured to extend radially outward from the center of the ceiling plate 111, and the lock protrusion portion 140*a* is formed at the top end portion of the lock mechanism 140 while an power point portion 140*e* is formed at the base end portion of the same. The power point portion 140*e* is formed higher by one step than the top end side, and the base end of the portion 140*e* is close to the outer one side 151*a* of a direct connector 15. In this embodiment, the first notch 151*b* is not formed in the one side 151*a*.

The external connector A is provided with a pushing member A1 for pushing the power point portion 140*e* downward when the external connector A is connected to the direct connector 15.

In the relay system 1 between relative rotation members configured thus, if the rotor 11 is assembled with the stator 12, the lock protrusion portion 140*a* is fitted into the lock recess portion 122*b*. Accordingly, the rotor 11 and the stator 12 are kept in a neutral state. If the external connector A is connected to the direct connector 15, the pushing member A1 makes the power point portion 140*e* move downward. Then, the lock mechanism 140 swings with the arms 140*d* and 140*d* as a fulcrum so that the lock protrusion portion 140*a* on its top end side moves upward. Consequently, the lock protrusion portion 140*a* comes off from the lock recess portion 122*b*, so that the relative rotation between the rotor 11 and the stator 12 can be performed freely.

Therefore, only by fitting the external connector A into the direct connector 15, the lock mechanism 140 swings so that the lock protrusion portion 140*a* comes off from the lock recess portion 122*b*. Accordingly, it is possible to save a labor to release these portions from the locked state. Other operations and effects the same as those in the first embodiment can be provided.

Although the lock mechanism 140 is configured to radially extend in the above embodiment, it may be configured to extend in the circumferential direction as shown in FIG.

16. That is, in FIG. 16, the lock mechanism 140 extends in the direction perpendicular to the other side 151*c* of the direct connector 15 from the neighborhood of the other side 151*c* perpendicular to the one side 151*a*. In this case, there is an advantage that the relative rotation temporary stop mechanism 14 can be installed even if the radial length of the ceiling plate 111 is short, that is, even if the diameters of the rotor 11 and the stator 12 are short. In addition, the lock mechanism 140 in FIG. 16 may be formed to be arcuate along the outer circumferential surface of the ceiling plate 111. In this case, the relative rotation temporary stop mechanism 14 can be installed even if the radial length of the ceiling plate 111 is further shorter.

Fourth Embodiment

Next, the fourth embodiment according to the present invention will be described below with reference to FIGS. 17 to 19. The constituents the same as those in the above third embodiment are referenced correspondingly, and description about them will be omitted here.

The notch 111*c* shown in this fourth embodiment is formed to be rectangular and to extend in the radial direction, as shown in FIGS. 17 and 18. In the lock mechanism 140, the base end of the power point portion 140*e* is disposed in the radial inside of the ceiling plate 111.

The power point portion 140*e* is configured so that it is pushed by a steering wheel (external connection mechanism) 2 when the rotor 11 is connected to the steering wheel 2. As a result, the power point portion 140*e* makes the lock mechanism 140, as a whole, swing with the arms 140*d* as a fulcrum, so that the lock protrusion portion 140*a* comes off from the lock recess portion 122*b*. The steering wheel 2 has a steering shaft 20 penetrating the inner cylinder 110 and a steering boss 21 provided around this steering shaft 20. The power point portion 140*e* is pushed by the bottom of this steering boss 21.

In the relay system 1 between relative rotation members configured thus, only by connecting the steering wheel 2 to the rotor 11, the lock protrusion portion 140*a* can be detached from the lock recess portion 122*b*. Accordingly, it is possible to save a labor to release these portions from the locked state. Other operations and effects the same as those in the third embodiment can be provided.

Although the description of the embodiments was made about the case in which the rotor 11 and the stator 12 were shown as a first rotor and a second rotor respectively, the present invention is also applicable to the case where the stator 12 and the rotor 11 are used as the first and second rotors respectively, and the stator 12 and the rotor 11 are provided with the lock mechanism 140 and the lock recess portion 120*a* or 122*b* respectively.

In addition, although the lock recess portions 120*a* and 122*b* were configured to have a bottom, they may be pierced in the thickness direction.

In the present invention configured thus, the lock protrusion portion of the lock mechanism is fitted into the lock recess portion by assembling the first rotor and the second rotor so that the relative rotation between the first rotor and the second rotor is prohibited. In this case, preferably, the first rotor and the second rotor are assembled with each other in their neutral position so that the lock protrusion portion is fitted into the lock recess portion.

That is, being connected to each other through a cable, the first and second rotors are rotatable freely relative to each other within a predetermined number of rotations. Accordingly, for example, in the case where the first and second rotors are installed in a rotation boundary portion between a body of a car and a steering wheel, it is preferable to attach the rotors in the rotation boundary portion in a state that they are set in a neutral position.

In any event, if the first and second rotors are locked and the initial condition of the relative rotation is established in advance, they can be installed as they are in the steering wheel or in any other rotation boundary portion. It is therefore possible to save such a labor that is required to adjust the rotation range while checking the allowance of the cable.

In addition, since the lock mechanism is provided integrally with the first rotor, it is possible to reduce the number of parts. In addition, since no mechanism is required for restricting or guiding the position of the lock mechanism, it is possible to simplify the structure. It is therefore possible to improve the workability of assembling and reduce the cost.

Further, if the first and second rotors are assembled, the lock protrusion portion is fitted directly into the lock recess portion so that the first and second rotors are brought into a locked state. It is therefore possible to save a labor to bring these rotors into a locked state. Moreover, only by fitting an external connector to the direct connector, the lock mechanism moves so that the lock protrusion portion comes off from the lock recess portion. It is therefore possible to save a labor to bring the rotors into an unlocked state.

In the present invention, only by connecting an external connection mechanism such as a steering wheel, or the like, to the first rotor, the lock mechanism moves so that the lock protrusion portion comes off from the lock recess portion. It is therefore possible to save a labor to bring the rotors into an unlocked state.

In the present invention, only by fitting an external connector to the direct connector, the lock mechanism swings so that the lock protrusion portion comes off from the lock recess portion. It is therefore possible to save a labor to bring the rotors into an unlocked state.

In the present invention, only by connecting an external connection mechanism such as a steering wheel, or the like, to the first rotor, the lock mechanism swings so that the lock protrusion portion comes off from the lock recess portion. It is therefore possible to save a labor to bring the rotors into an unlocked state.

What is claimed is:

1. A relay system between relative rotation members comprising:

first and second rotors which rotate relative to each other and which are connected electrically to each other through a cable;

a relative rotation temporary stop mechanism for temporarily stopping the relative rotation between said first and second rotors, said relative rotation temporary stop mechanism including:

a lock mechanism formed unitarily with said first rotor so as to be elastically displaceable relative to said first rotor; and a lock recess portion provided in said second rotor, wherein said lock mechanism is engageable with said lock recess portion, wherein said lock mechanism includes a lock protrusion portion that is provided at a top end and an inclined portion that is provided at a base end, said lock protrusion portion being fitted into said lock recess portion, locking said first and second rotors together, wherein said relay system further comprises a direct connector, for connecting said cable to the outside, provided in said first rotor, and wherein, when an external connector is connected to said direct connector, said inclined portion is pushed by said external connector to thereby move said lock mechanism so that said lock protrusion portion is detached from said lock recess portion to unlock said first and second rotors.

* * * * *